United States Patent [19]

Stewart et al.

[11] Patent Number: 4,631,121

[45] Date of Patent: Dec. 23, 1986

[54] ALUMINA REDUCTION CELL

[75] Inventors: Douglas V. Stewart, Florence; Alton T. Tabereaux, Sheffield; John T. Willett, Florence, all of Ala.

[73] Assignee: Reynolds Metals Company, Richmond, Va.

[21] Appl. No.: 826,727

[22] Filed: Feb. 6, 1986

[51] Int. Cl.[4] ..... C25C 3/08; C25C 7/04; C25C 7/02

[52] U.S. Cl. ..... 204/243 R; 204/288; 204/291; 204/294; 204/290 R

[58] Field of Search ..... 204/67, 243 R–247, 204/286–288, 291, 294, 290 R

[56] References Cited

U.S. PATENT DOCUMENTS

| | | | |
|---|---|---|---|
| 3,287,247 | 11/1966 | Dewey | 204/243 |
| 4,177,128 | 12/1979 | Rahn | 204/243 R |
| 4,308,115 | 12/1981 | Foster, Jr. et al. | 204/67 |
| 4,339,316 | 7/1982 | Peterson et al. | 204/243 R |
| 4,349,427 | 9/1982 | Goodnow et al. | 204/294 X |
| 4,436,598 | 3/1984 | Tabereaux et al. | 204/67 |
| 4,460,440 | 7/1984 | McGeer | 204/67 |
| 4,504,366 | 3/1985 | Jarrett et al. | 204/67 X |
| 4,532,017 | 7/1985 | Keinborg et al. | 204/67 |
| 4,533,452 | 8/1985 | Leroy et al. | 204/284 X |

*Primary Examiner*—Donald R. Valentine
*Attorney, Agent, or Firm*—Alan T. McDonald

[57] ABSTRACT

An improved alumina reduction cell is described in which the carbonaceous cathode includes refractory hard metal shapes projecting upwardly from the cell surface thereof, forming the true cathode surface, and permanently mounted and replaceable protective sleeves formed of inert refractory material surrounding the refractory hard metal shapes and protecting these shapes from accidental contact by the anode.

10 Claims, 2 Drawing Figures

ALUMINA REDUCTION CELL

BACKGROUND OF THE INVENTION

Aluminum metal is conventional produced by the electrolytic reduction of alumina dissolved in a molten cryolite bath according to the Hall-Heroult process.

This process for reducing alumina is carried out in a thermally insulated cell or "pot" which contains the alumina-cryolite bath. The cell floor, typically made of a carbonaceous material, overlies some of the thermal insulation for the cell and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor. Resting on the cell floor is a layer or "pad" of molten aluminum which the bath sees as the true cathode. The anode, which projects down into the bath, is normally spaced from the pad at a distance of about 1.5 to 3.0 inches (3.81 to 7.61 cm). The alumina-cryolite bath is maintained on top of the pad at a depth of about 6.0 to 12.0 inches (15.24 to 30.48 cm).

As the bath is traversed by electric current, alumina is reduced to aluminum at the cathode and carbon is oxidized to its dioxide at the anode. The aluminum thus reduced is deposited on the pad and tapped off periodically after it has accumulated.

For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thinly on carbonaceous materials, the pad can best be visualized as a massive globule on the cell floor. In larger cells, the dense currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minimize reoxidation of aluminum.

Still, the movements of the pad have adverse effects which cannot always be readily controlled. For a given cell operating with a particular current of electrolysis, there is an ideal working distance between the cathode and the anode for which the process will be most energy efficient. However, the required spacing of the anode due to turbulence of the pad prevents this ideal working distance from being constantly maintained. Further, since the pad is in a state of movement, a variable, nonuniform working distance is presented. This variable interelectrode distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constituents. It has been suggested in the literature and prior patents that certain special materials, such as refractory hard metals (RHM), most notably titanium diboride ($TiB_2$) or its homologs, can be used advantageously in forming the cell floor. Further, it has been found that RHM shapes may be imbedded into or placed onto the cell floor, rising vertically through the molten aluminum layer and into the cyrolite-alumina bath, with the uppermost ends of these shapes forming the true cathode. When such a cathode design is employed, precise spacing between the true or active surfaces of the cathode and the anode may be maintained, since such a system is not effected by the ever-moving molten aluminum pad acting as the true cathode surface.

Ideally, in contrast to conventional carbon products, these RHM materials are chemically compatible with the electrolytic bath at the high temperatures of cell operation and are also comparable chemically with molten aluminum.

Furthermore, these special cell floor materials are wetted by molten aluminum. Accordingly, the usual thick metal pad should no longer be required, and molten aluminum may be maintained on the cell floor as a relatively thin layer and commensurate with amounts accumulating between the normal tapping schedule.

With all their benefits, there is a problem associated with the use of RHM shapes in alumina reduction cells. These shapes are extremely brittle, and may be broken by contact with an anode lowered thereupon. Anode movement in a cell occurs quite often during aluminum production, due to the need to change anodes, tap aluminum from the cell or adjust the voltage within the cell. Should these shapes be accidently contacted by a lowered anode, and thus broken, increased down time results, due to the need to again raise the anode and replace the shapes, or, in a more extreme case, drain the cell, replace the shapes, and restart the cell.

In U.S. Pat. No. 4,436,598, the disclosure of which is hereby incorporated herein by reference, it is suggested to position anode stops within the cell. These stops are imbedded within the carbonaceous cathode and extend into the alumina-cryolite bath for a greater distance than the RHM shapes. If the anode is lowered upon these stops, the stops protect the RHM shapes from contact and breakage. The stops are formed of a material which is not a conductor of electricity, so that the RHM shapes remain the true cathode. Suitable materials for the anode stops include silicon nitride, silicon carbide, aluminum nitride and boron nitride.

It has been found, however, that, while these anodes stops were effective in protecting the RHM shapes, and while the portion of the anode stop within the aluminum pad exhibits very little deterioration during cell operation, the portion of the anode stops projecting into the alumina-cryolite bath eventually eroded away due to the solubility of the refractory material in the cryolite. Thus, it has been found that these anode stops loose their effectiveness in protecting the RHM shapes after about six months of operation in the cell. Because the anode stops were permanently mounted within the cell, replacement of these stops required shutdown and drain of the cell, which is not cost effective.

There remains, however, a need for effective protection of refractory hard metal shapes in alumina reduction cells. It is thus a primary objective of the present invention to provide an improved protection system for refractory hard metal shapes in alumina reduction cells.

THE PRESENT INVENTION

By means of the present invention, this desired objective has been obtained. The alumina reduction cell of the present invention includes a RHM shape protection system including the RHM shape which rests on the carbonaceous cell floor, but which is not attached thereto, such that the RHM shape may be easily replaced during cell operation, a relatively short positioning element surrounding the RHM shape, which is permanently affixed to the carbonaceous cathode and which has a height less than the height of the aluminum pad and a taller, replaceable anode stop element which surrounds both the RHM shape and the positioning shape. This replaceable anode stop element is not fixed to the cathode. It has a height in excess of the RHM shape, to protect the RHM shape from lowering of the anode and includes a carbonaceous coating containing a refractory hard metal powder to reduce its dissolution in the alumina-cryolite bath. The coating will be wetted by the aluminum metal, thus protecting the ceramic/refractory anode stop from dissolution.

BRIEF DESCRIPTION OF THE DRAWINGS

The alumina reduction cell of the present invention will be more fully described with reference to the drawings in which.

DETAILED DESCRIPTION OF THE PREFERRED EMBODIMENT

Figure 1:
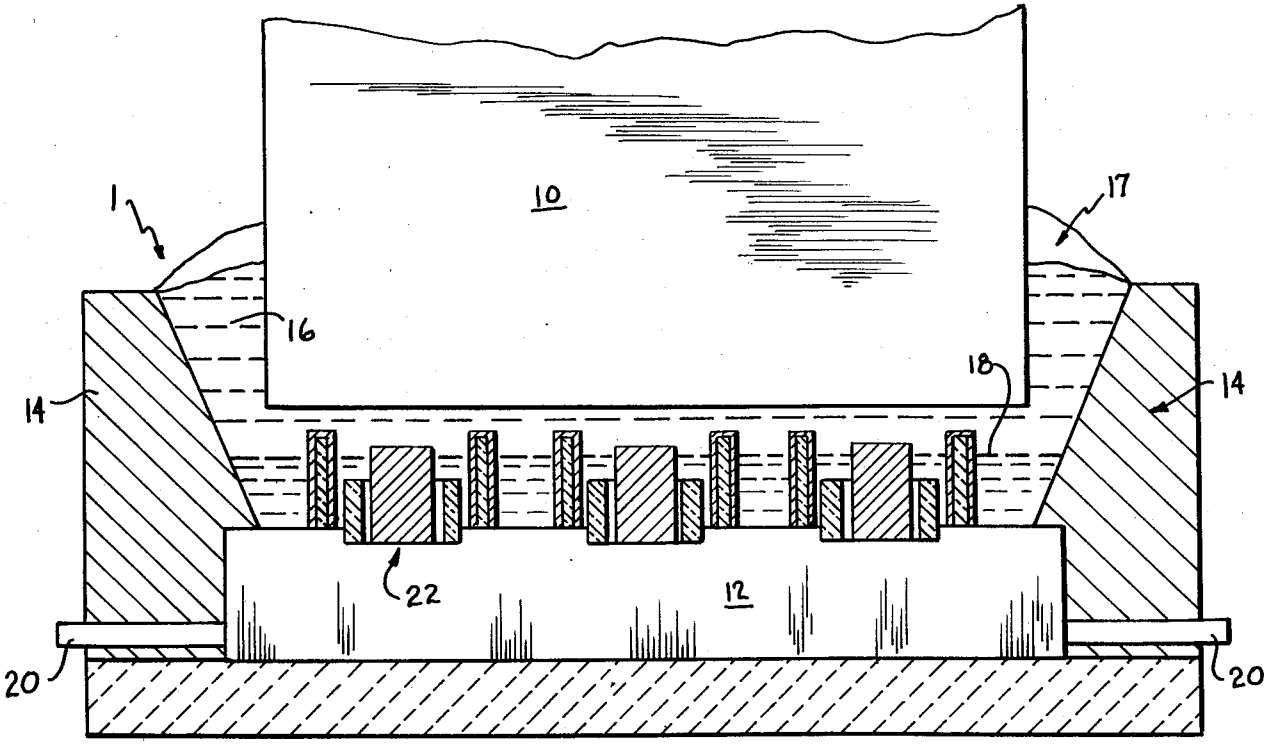
FIG. 1 is a side elevational view of an alumina reduction cell, with the end wall removed, according to the practice of the present invention.

FIG. 1 illustrates an alumina reduction cell 1 employing the present invention. Anode blocks 10, formed from a carbonaceous material, are suspended within a bath 16 of alumina dissolved in molten cryolite and are attached to a source of electrical current by means not shown. A crust 17 of frozen cryolite-alumina covers the bath 16. Carbonaceous cathode blocks 12 may be joined together by a rammed mixture of pitch and ground carbonaceous material or by means of a carbonaceous cement, by means well-known to those skilled in the art. These cathode blocks 12 are connected by means of conductor bus bars 20 to the electrical current source to complete the electrical circuit. Outer walls 14 form the side and end supporting structures for the cell 1. The walls 14 may be formed, for example, from graphite blocks held together with a graphitic cement.

Figure 2:
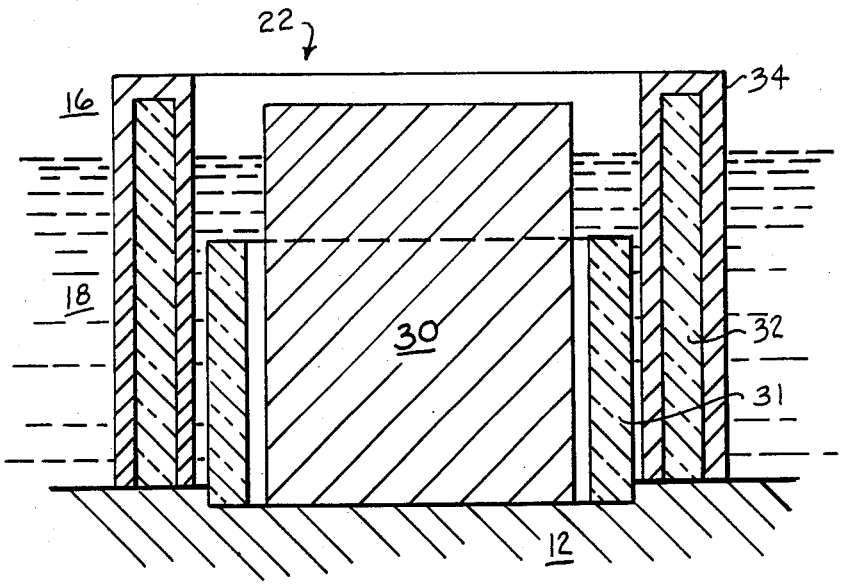
FIG. 2 is an expoded cross-sectional view of one of the RHM shape-anode stop units employed in the present invention.

The carbonaceous blocks 12 include a plurality of refractory hard metal (RHM) shape containing units 22. These units 22 are more fully described in FIG. 2.

The RHM units 22 include a central RHM shape 30. The RHM shape 30 may take any of numerous cross-sectional shapes, such as rectangular, square or the like, but is preferably in the form of a cylinder, due to ease of forming of such a shape. The shapes 30 are refractory hard metal (RHM) shapes, which may be formed of such materials as $TiB_2$, $TiB_2$-ARN mixtures, and other similar materials, typically by hot pressing or sintering RHM powders to form the shapes. These refractory hard metal materials are wetted by molten aluminum, where they pass through the molten aluminum layer 18, preventing globules of molten aluminum from forming at the interfaces with the shapes 30 and reducing movement of the molten aluminum pad 18. To minimize cracking during use of these shapes, due to the brittleness of the RHM materials, the RHM shapes 30 may be reenforced with carbon, graphic or silicon carbide fibers or particles, which are added to the powders forming these shapes 30 prior to hot pressing or sintering. When fibers are employed, the fibers may be random or uniform in length and are oriented in the plane perpendicular to the direction of hot pressing. The fibers or particles act to resist tensile stresses that could result in cracking during use.

The RHM shapes 30 are not fixed to the carbonaceous cathode 12, but rather rest on the surface of the cathode 12. Thus, the RHM shapes are easily replaceable during the life of the cell by hot exchange. To stabilize the RHM shapes 30, a short ceramic/refractory positioning element or sleeve 31 surrounds the RHM shape. This element 31 is fixedly mounted to the carbonaceous cathode, such as by cementing with a carbonaceous cement or the like, and has a cross-sectional shape corresponding to that of the RHM shape 30. This orienting and stabilizing element 31 is shorter than the RHM shape 30 and has a height less than the metal pad 18 to prevent dissolution of the material forming the stabilizing or orienting shape 31 in the alumina-cryolite bath. This stabilizing element 31 may be formed of such materials as silicon nitride bonded silicon carbide, aluminum nitride, silicon nitride, silicon carbide, boron nitride and the like. The inner diameter of the stabilizing element 31 is slightly larger than the outer diameter of the RHM shape 30, such as about 0.0625 to about 0.375 inches (0.1588 to about 0.9525 cm), so that the RHM shape is easily removed and replaced, but yet closely enough corresponding to the RHM shape to stabilize it in the cell. The RHM shape and the stabilizing sleeve may be positioned in a depression within the cathode 12.

Surrounding the permanently mounted stabilizing element 31 is a replaceable anode stop 32. Anode stop 32 extends into the alumina-cryolite bath for a distance slightly in excess of that of RHM shape 30, for example, about 0.250 to about 0.375 inches (0.635 to about 0.9525 cm), to provide protection for the RHM shape 30 against lowering of the anode 10 thereupon. The anode stop 32 is also from about 0.0625 to about 0.125 inches (0.1588 to about 0.3175 cm) larger in its inner diameter than the outer diameter of stabilizing element 31, to permit easy removal and replacement of anode stop 32. Anode stop 32 is, therefore, not fixed to the carbonaceous cathode 12, but rather rests thereupon.

The anode stop 32 may be formed of the same ceramic/refractory materials as is stabilizing element 31. Since, however, anode stop 32 extends into the cryolite-alumina bath, anode stop 32 further comprises a carbonaceous coating containing a refractory hard metal powder, such as $TiB_2$ powder, thereon. This coating is wetted by aluminum metal, and thus protects the ceramic/refractory anode stop material from dissolution in the cryolite-alumina bath.

To permit molten aluminum metal to flow freely within the cell, elements 31 and 32 each contain one or more slots or holes therein near the base thereof.

From the foregoing, it is clear that the present invention provides a simple, yet effective, means for preventing damage to RHM shapes within an alumina reduction cell, while improving the life of the protection means.

While presently preferred embodiments of the invention have been illustrated and described, it is clear that the invention may be otherwise variously embodied in practice within the scope of the following claims.

We claim:

1. In an alumina reduction cell having an anode, a carbonaceous cathode and a plurality of refractory hard metal (RHM) shapes resting upon, but not fixedly mounted to, said cathode, said RHM shapes having a height sufficient to extend vertically upwardly from said cathode, through a molten aluminum pad and into an alumina-cryolite bath, the improvement comprising inert refractory stabilizing sleeves surrounding said RHM shapes and fixedly mounted to said cathode, said stabilizing sleeves having a height less than said RHM shapes such that said stabilizing sleeves extend vertically into said molten aluminum pad but not into said alumina-cryolite bath, and inert refractory anode stops surrounding said stabilizing sleeves, said anode stops resting upon, but not fixedly mounted to, said cathode and having a height greater than said RHM shapes.

2. The cell of claim 1 wherein said stabilizing sleeves and said anode stops are each formed from a material selected from the group consisting of silicon carbide, silicon nitride, aluminum nitride and boron nitride.

3. The cell of claim 2 wherein said stabilizing sleeves and/or said anode stops are formed from silicon nitride bonded silicon carbide.

4. The cell of claim 1 wherein said stabililzing sleeves are cemented into said cathode by means of a carbonaceous cement.

5. The cell of claim 1 wherein said RHM shapes and said stabilizing sleeves are positioned into depressions formed in said cathode.

6. The cell of claim 1 wherein said RHM shapes are formed from a material selected from the group consisting of titanium diboride and titanium diboride-aluminum nitride mixtures.

7. The cell of claim 1 wherein said RHM shapes are fiber reinforced.

8. The cell of claim 1 wherein said RHM shapes, said stabilizing sleeves and said anode stops are each in the form of cylinders.

9. The cell of claim 1 wherein said stabilizing sleeves and said anode stops each include at least one opening therein to permit said molten aluminum to flow freely in said cell.

10. The cell of claim 1 wherein said anode stops are coated with a carbonaceous coating having RHM powder mixed therein.

* * * * *